US005355699A

United States Patent [19]

Inagaki et al.

[11] Patent Number: 5,355,699

[45] Date of Patent: Oct. 18, 1994

[54] FLAT KNITTING MACHINE AND A METHOD OF OPERATING THE ROCKING SINKERS OF THE FLAT KNITTING MACHINE

[75] Inventors: Katsumi Inagaki; Atsuo Tsuboi; Shoichi Komasaka, all Fuji, Japan

[73] Assignee: Tsudakoma Kogyo Kabushiki Kaisha, Ishikawa, Japan

[21] Appl. No.: 45,700

[22] Filed: Apr. 14, 1993

[30] Foreign Application Priority Data

Apr. 16, 1992 [JP] Japan ..... 4-096724

[51] Int. Cl.[5] ..... D04B 15/06

[52] U.S. Cl. ..... 66/64; 66/60 R; 66/106

[58] Field of Search ..... 66/60 R, 64, 106, 104

[56] References Cited

U.S. PATENT DOCUMENTS

| | | | |
|---|---|---|---|
| 2,960,854 | 11/1960 | Eberl | 66/60 X |
| 2,972,242 | 2/1961 | Eberl | 66/64 |
| 3,024,633 | 3/1962 | Kuntz | 66/106 X |
| 3,326,017 | 6/1967 | Tschümperlin et al. | 66/64 |
| 3,440,839 | 4/1969 | Tschümperlin et al. | 66/64 |
| 4,713,948 | 12/1987 | Schmidt et al. | 66/106 |
| 4,768,357 | 9/1988 | Ohtake | 66/75.2 |

FOREIGN PATENT DOCUMENTS

| | | | |
|---|---|---|---|
| 2430824 | 1/1976 | Fed. Rep. of Germany . | |
| 2545212 | 4/1977 | Fed. Rep. of Germany . | |
| 48-30612 | 9/1973 | Japan . | |
| 3-206161 | 9/1991 | Japan . | |
| 0609801 | 6/1978 | U.S.S.R. | 66/106 |

*Primary Examiner*—Clifford D. Crowder
*Assistant Examiner*—John J. Calvert
*Attorney, Agent, or Firm*—Burns, Doane, Swecker & Mathis

[57] ABSTRACT

The present invention provides a flat knitting machine having a simple construction and provided with rocking sinkers capable of stably operating for high-speed knitting operation without damaging the yarns, and a method of operating the rocking sinkers. The flat knitting machine is provided with rocking sinkers (8), sinker operating means (3) for operating the sinkers (8), needle operating means (19), and a power transmitting mechanism (4, 21) interlocking the needle operating means (19) and the sinker operating means (3) to operate the sinker operating means (3) by at least part of the motion of the needle operating means (19).

6 Claims, 10 Drawing Sheets

FLAT KNITTING MACHINE AND A METHOD OF OPERATING THE ROCKING SINKERS OF THE FLAT KNITTING MACHINE

BACKGROUND OF THE INVENTION

1. Field of the Invention

The present invention relates to a flat knitting machine comprising two needle beds disposed opposite to each other along a stitching line, a plurality of needles slidably supported on the two needle beds, needle operating means for operating the needles for sliding movement on the needle beds, and rocking sinkers arranged on either one of the needle beds or both the needle beds in connection with the needles, so as to rock about an axis parallel to the stitching line; and to a method of operating the rocking sinkers of the flat knitting machine.

2. Description of the Prior Art

A hand-knitting machine (flat knitting machine) provided with rocking sinkers is disclosed in Japanese Examined Patent Publication (Kokoku) No. 48-30612. The rocking sinkers are operated by a sinker cam mounted on a carriage. This hand-knitting machine is provided with a sinker control mechanism including elastic friction members (pieces of felt) placed in direct, sliding contact with each rocking sinker, respectively, to restrain the rocking sinkers from free movement. If rocking sinkers combined with such a sinker control mechanism are used on a flat knitting machine that operates at a high knitting speed, the sinkers are unable to operate stably.

A two-bed flat knitting machine provided with rocking sinkers disposed between the adjacent needles on both the needle beds is disclosed in Japanese Examined Patent Publication (Kokoku) No. 2-10260. These rocking sinkers are controlled by cams mounted on a carriage. When this flat knitting machine operates at a high knitting speed or yarns having a relatively low strength are knitted on this flat knitting machine, the yarns are liable to be broken.

SUMMARY OF THE INVENTION

Accordingly, it is an object of the present invention to provide a flat knitting machine capable of solving problems residing in the known flat knitting machines provided with rocking sinkers, having a simple construction, and provided with rocking sinkers capable of stable operation even when the flat knitting machine operates at a high knitting speed and of not damaging the knitting yarns; and a method of operating the rocking sinkers of the flat knitting machine.

A flat knitting machine provided with rocking sinkers in accordance with the present invention is provided with sinker operating means and needle operating means, and the sinker operating means and the needle operating means are interlocked by a power transmitting mechanism so that the motion of the sinker operating means is caused by at least part of the motion of the needle operating means.

A preferable method of operating the rocking sinkers of the foregoing flat knitting machine turns each rocking sinker from its retracted position to its advanced position by moving the sinker operating means in synchronism with the rising of the corresponding needle, stops the turning of the rocking sinker when the resistance against the turning of the rocking sinker increases as the needle continues to rise, returns the rocking sinker from the advanced position to the retracted position by moving the sinker operating means synchronously with the needle as the needle descends, and further lowers the needle after the rocking sinker has been retracted from the advanced position to the retracted position.

Preferably, this flat knitting machine employs sinker jacks as the sinker operating means, and an elastic interlocking means as the power transmitting mechanism. Each sinker jack is fitted slidably in a groove formed in a guide member arranged on the needle beds in parallel to the needle grooves and has one end engaging the rocking sinker. The elastic interlocking means is disposed between the sinker jack, and the needle or a connecting jack connected to the needle. In this flat knitting machine, the rocking sinker can be moved by at least part of the motion of the needle without using any special cam for moving the rocking sinker, which simplifies the construction of the flat knitting machine. The needle can be moved with the rocking sinker stopping when resistance against the rocking motion of the rocking sinker exceeds a specific level by properly determining the power transmitting ability of the elastic interlocking means, which prevents damaging the knitting yarns.

Although the present invention is effective when applied to a flat knitting machine of a known construction, namely, a flat knitting machine provided with a carriage, that operates at a high knitting speed and/or knits a knitted fabric having a complex stitch and a sophisticated pattern, the present invention is very effective when applied to a high-speed carriageless flat knitting machine proposed in Japanese Examined Patent Publication (Kokoku) No. 1-012855 by the applicant of the present patent application. This high-speed carriageless flat knitting machine comprises: at least one set of knitting mechanisms comprising a plurality of parallel needles arranged in a plane and needle guide members laterally extended within the plane, determining the intervals between the plurality of needles and capable of forming loops; at least one traveling base plate capable of laterally traveling along the needle guide members; at least one yarn feed device mounted on the traveling base plate; actuators individually connected to the plurality of needles to slide the needles; a storage device for storing a specified knitting plan; and a controller for controlling the actuators according to the knitting plan so that the actuators operate synchronously with the lateral reciprocation of the yarn feed device.

This previously proposed flat knitting machine is able to employ, as the actuator, either a thin linear motor or a miniature rotary motor and a device for converting the rotary motion of the rotary motor into a linear motion. The sinker operating means may be interlocked with the connecting jack disposed between the needle and the linearly moving output shaft of the actuator by the elastic interlocking means.

BRIEF DESCRIPTION OF THE DRAWINGS

The above and other objects, features and advantages of the present invention will become more apparent from the following description taken in connection with the accompanying drawings, in which:

FIGS. 3(A) to 3(D) are schematic views of an elastic interlocking means consisting of a serration and a plate spring, in which FIG. 3(A) is a plan view of the serration formed in the butt of a connecting jack, FIG. 3(B) is an enlarged plan view of the serration, FIG. 3(C) is an enlarged plan view of the serration and the plate spring, in which the connecting jack is urging a sinker jack through the serration and the plate spring flexed by a ridge of the serration, and FIG. 3(D) is an enlarged plan view of a plate spring having an initial bend represented by a distance $\delta$;

DETAILED DESCRIPTION OF THE PREFERRED EMBODIMENTS

Figure 1B:
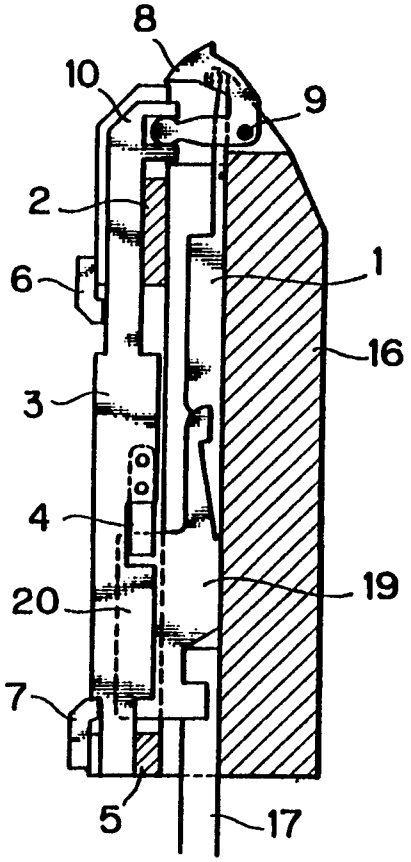
FIG. 1(B) is a longitudinal sectional view taken along the lines A—A of FIG. 1(A)
Figure 1A:
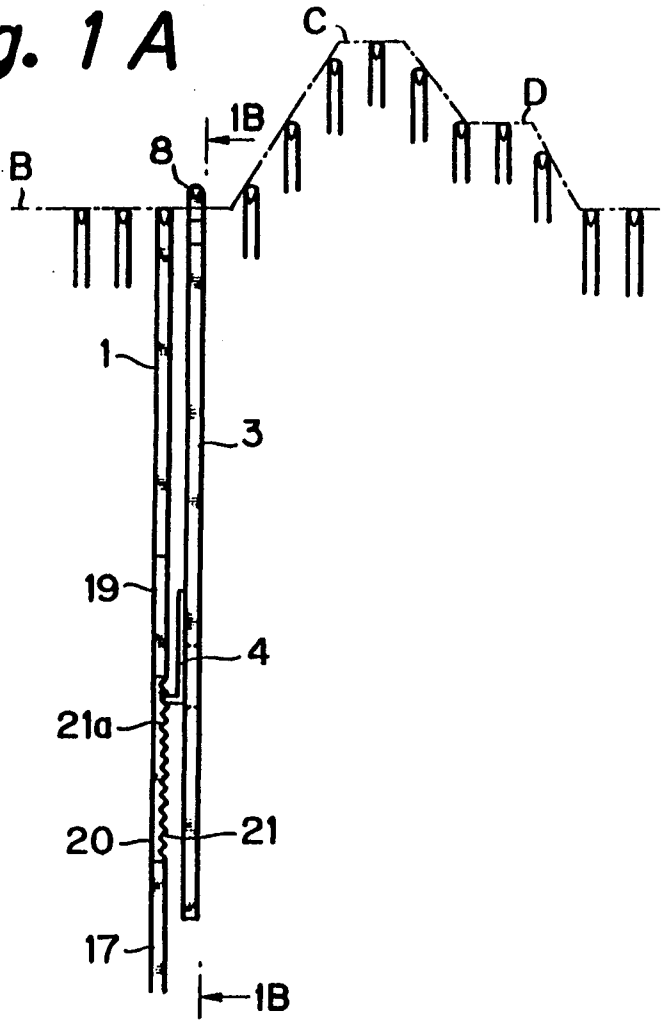
FIGS. 1(A) is a plan view of an essential portion of a flat knitting machine in a preferred embodiment according to the present invention.

FIGS. 1(A) and 1(B) are a plan view and a longitudinal sectional view, respectively, of an essential portion of the flat knitting machine embodying the present invention.

Referring to FIGS. 1(A) and 1(B), a plurality of needles 1 are arranged on a needle bed 16, each needle is operated by a connecting jack 19 connected to an actuator shaft 17. The needles 1 slide upward and downward for knitting.

Sinker jacks 3 are arranged on the needle bed 16 in combination with the needles 1, respectively. A plate spring 4 fixed to each sinker jack 3 is in contact with the connecting jack 19 to interlock the sinker jack 3 with the connecting jack 19. Each sinker jack 3 is guided by an upper guide member 2 and a lower guide member 5, which are disposed on the needle bed 16, for sliding movement between an upper stopper 6 and a lower stopper 7. Rocking sinkers 8 are supported pivotally on the upper end of the needle bed 16 with pins 9. Each rocking sinker 8 has a circular joint head 8*b* (FIG. 2) fitted in a recess formed in the upper end of the sinker jack 3. The rocking sinker 8 is turned in opposite directions on the pin 9 by the sinker jack 3.

Figure 2:
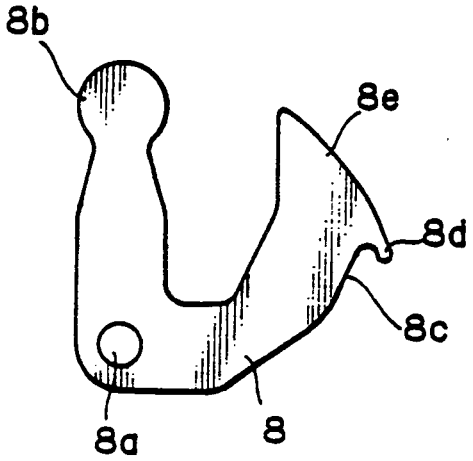
FIG. 2 is a side view of a rocking sinker.

Referring to FIG. 2, the rocking sinker 8 has a hole 8*a* receiving the pin 9, the circular joint head 8*b*fitted in the recess of the sinker jack 3, a working edge 8*c* for forming a loop, a projection 8*d* for holding down the fabric, and a circular edge 8*e* having the shape of an arc of a circle. When the rocking sinker 8 is turned, the projection 8*d* depresses the fabric, retaining the loop on the working edge 8*c*. The circular edge 8*e* enables the yarn to slip off the rocking sinker 8 without being caught by the rocking sinker 8 even if the traveling yarn is brought into contact with the rocking sinker 8.

Figure 3A:
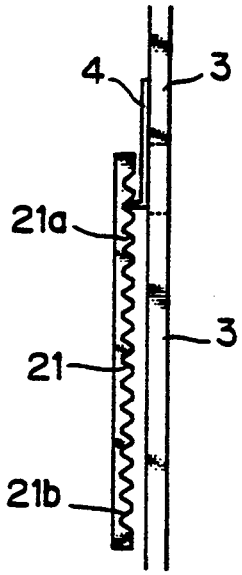

Referring to FIG. 3(A), the butt 20 of the connecting jack 19 has a portion provided with serration 21, and a raised end of the plate spring 4 fixed to the sinker jack 3 is in elastic engagement with the serration 21. The plate spring 4 is riveted or welded to the sinker jack 3. The plate spring 4 and the serration 21 constitute the elastic interlocking means that engages the sinker jack 3 and the connecting jack 19 frictionally to enable the connecting jack 19 to move the sinker jack 3. If the resistance against the motion of the sinker jack 3 exceeds a certain level, the sinker jack 3 slips relative to the connecting jack 19 and only the connecting jack 19 continues to move.

Figure 3B:
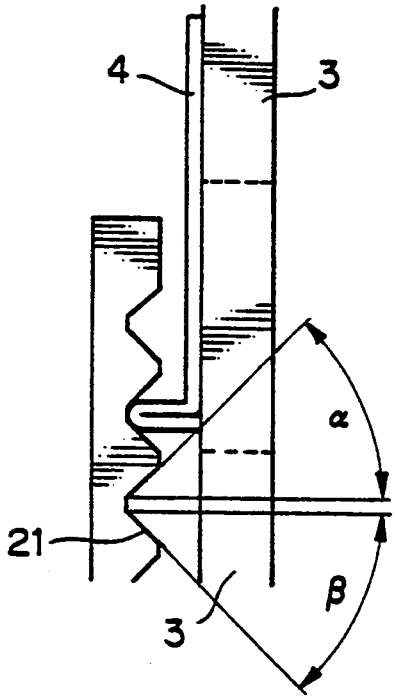
Figure 3C:
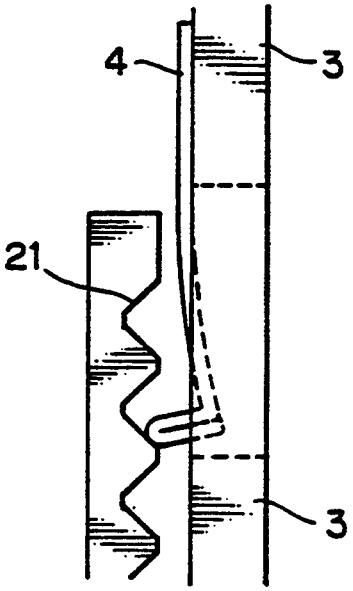

FIG. 3(B) is an enlarged view of a portion of FIG. 3(A). When applied to a 10 G flat knitting machine in accordance with the present invention, by way of example, the elastic interlocking means could transmit a force in the range of 300 to 400 gf through the serration 21 and the plate spring 4 to the sinker jack 3. In FIG. 3(C), the serration 21 of the butt 20 of the connecting jack 19 is in engagement with the plate spring 4 to transmit a force to the sinker jack 3 to raise the sinker jack 3, and the plate spring 4 is flexed. The force increases to a maximum immediately before the raised end of the plate spring 4 rides over a ridge of the serration 21.

Figure 3D:
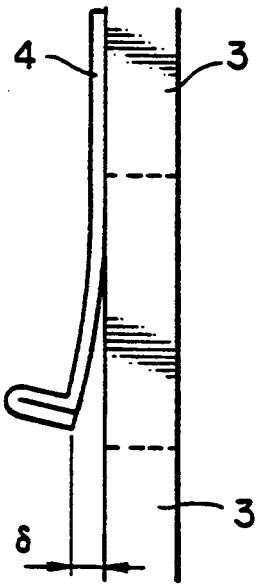

In FIG. 3(B), $\alpha$ and $\beta$ are the respective inclinations of the back side and front side of each ridge of the serration 21. In this embodiment, $\alpha=\beta=45°$. A greater force can be transmitted from the connecting jack 19 to the sinker jack 3 by the cooperative agency of the serration 21 and the plate spring 4 to the sinker jack 3 to raise the sinker jack by decreasing the inclination $\beta$ and to lower the sinker jack 3 by decreasing the inclination $\alpha$. If it is desired to transmit an even greater force from the connecting jack 19 to the sinker jack 3, an initial bend represented by $\delta$ in FIG. 3(D) may be introduced in the plate spring 4 so that the pressure of the plate spring 4 against the serration 21 is increased and the pressure of the plate spring 4 is relatively high even in a state in which the raised end of the plate spring 4 is in engagement with a furrow of the serration 21. It is also possible to increase the pressure of the plate spring 4 against the serration 21 by increasing the thickness of the plate spring 4 to increase the spring constant of the same, or the height of the ridges of the serration 21 may be increased for the same effect. If it is desired to reduce the force to be transmitted from the connecting jack 19 to the sinker jack 3, measures having an effect reverse to that of the foregoing measures for increasing the force may be taken.

Although the faces of the ridges of the serration 21 in this embodiment are flat, naturally, the faces of the ridges may be curved for the same effect.

The power transmitting motions of the sinker jack 3 and the connecting jack 19 and the resultant rocking motion of the rocking sinker 8 will be described hereinafter.

Referring to FIGS. 1(A) and 1(B), in a state in which the needle 1 is at the stitching position B, i.e., the lowest position, the connecting jack 19 is at its lowest position, the sinker jack 3 is in abutment with the lower stopper 7 at its lowest position, the rocking sinker 8 engaging the upper end 10 of the sinker jack 3 has been turned counterclockwise to its open position, and the plate spring 4 is in engagement with the upper portion 21*a* of the serration 21 of the connecting jack 19 to retain the sinker jack at its lowest position.

The power transmitting motions of the sinker jack 3 and the rocking sinker 8 when the needle 1 is raised from the stitching position B to the clearing position C by the connecting jack 19 connected to the actuator shaft 17 will be described hereinafter.

Figure 4:
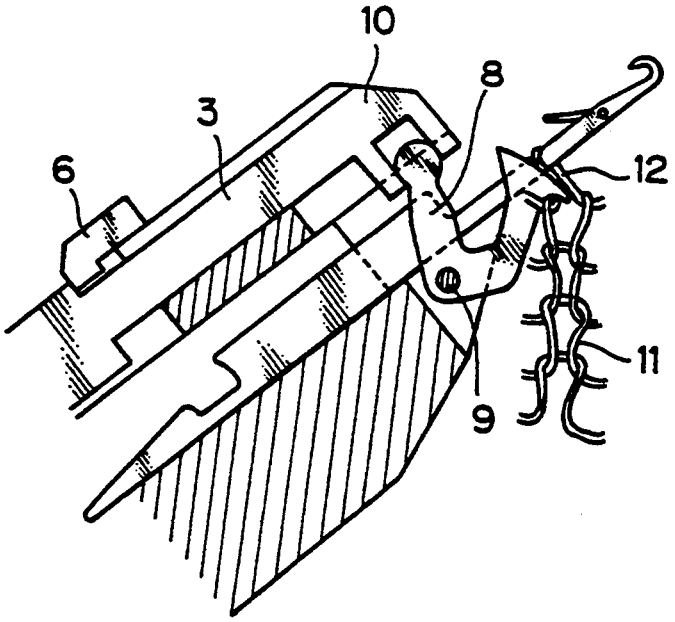
FIG. 4 is a longitudinal sectional view of a portion of the flat knitting machine in a state in which the rocking sinker is holding down the fabric and the old loop.

The plate spring 4 pressing on the upper portion 21*a* of the serration 21 of the connecting jack 19 does not move relative to the connecting jack 19, and the sinker jack 3 moves together or simultaneously with the connecting jack 19 as the connecting jack 19 is raised until it is stopped by the upper stopper 6, when an excessively large resistance does not act against the movement of the sinker jack 3. Consequently, the rocking sinker 8 engaging the front end 10 of the sinker jack 3 is turned clockwise to its closed position to hold down the fabric 11 and to prevent raising motion of the old loop 12 as shown in FIG. 4.

Figure 5B:
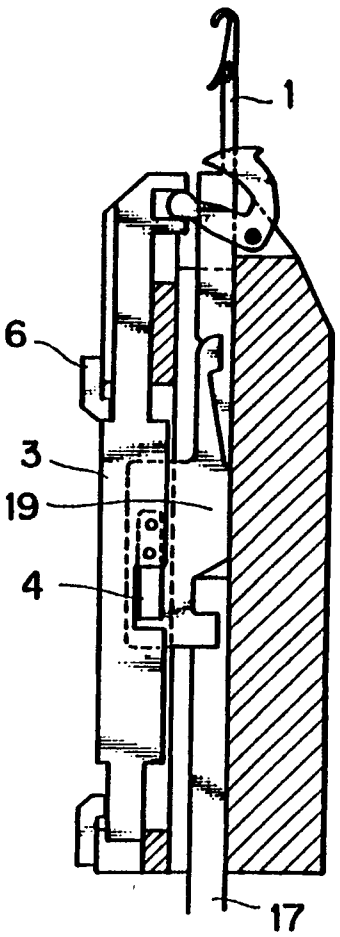
FIG. 5(B) is a longitudinal sectional view taken along the lines A—A of FIG. 5(A)
Figure 5A:
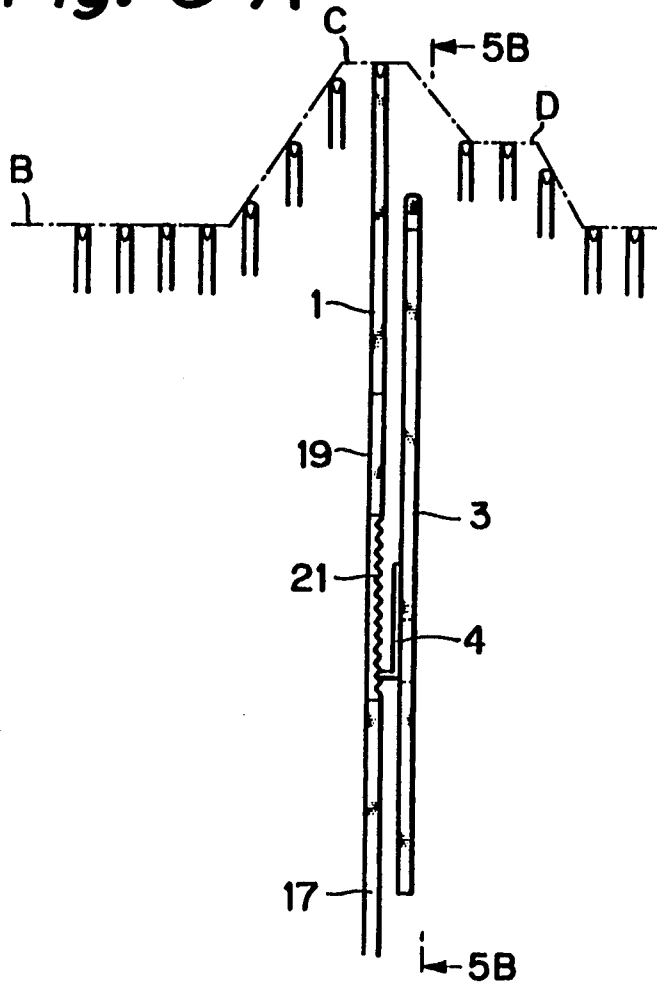
FIGS. 5(A) is a plan view of a portion of the flat knitting machine of FIG. 1, showing the respective positions of the components with the needle raised to the clearing position C.

Since the sinker jack 3 is unable to move upward after the sinker jack 3 has been stopped by the upper stopper 6, the plate spring 4 is flexed by the serration 21 of the connecting jack 19 and the ridges of the serration 21 ride over the raised end of the plate spring 4 to enable the connecting jack 19 to rise further relative to the sinker jack 3. Consequently, as shown in FIGS. 5(A) and 5(B), the sinker jack 3 is retained at its uppermost position and the connecting jack 19 is raised by the actuator shaft 17 to raise the needle 1 to the clearing position C.

Figure 6B:
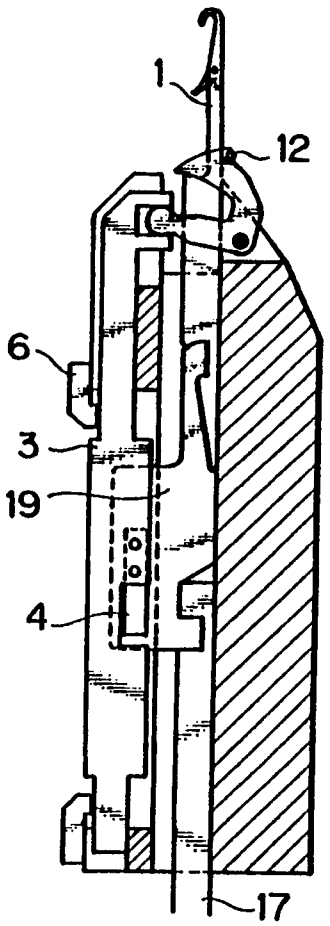
FIGS. 6(A) and 6(B) are a plan view and a longitudinal sectional view similar to FIGS. 5(A) and 5(B), respectively, of a portion of the flat knitting machine of FIG. 1, showing the respective positions of the components with the needle raised to the clearing position C and the sinker jack being restrained from rising by an excessively large resistance acting against the sinker jack.
Figure 6A:
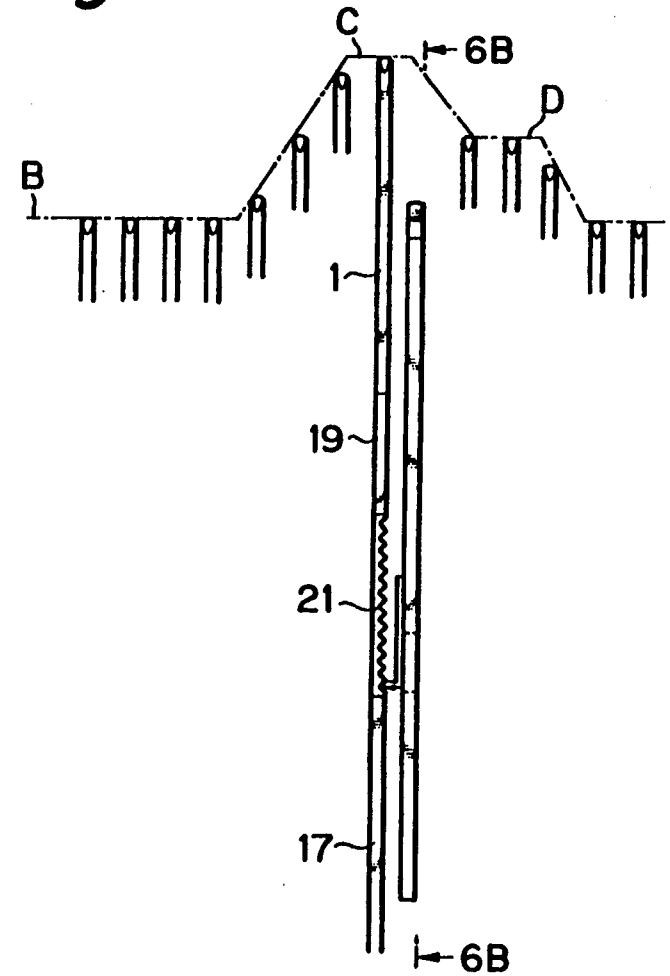

When the load on the rocking sinker 8 in holding down the fabric or in preventing the raising motion of the old loop 12 is excessively large, the resistance against the upward movement of the sinker jack 3 increases beyond the raising force applied to the sinker jack 3 by the engagement of the serration 21 of the connecting jack 19 and the plate spring 4 even before the sinker jack 3 is stopped by the upper stopper 6 and, consequently, the connecting jack 19 starts moving upward relative to the sinker jack 3. That is, as shown in FIGS. 6(A) and 6(B), the connecting jack 19 is raised to its uppermost position by the actuator shaft 17 to raise the needle 1 to the clearing position C, while the sinker jack 3 remains stopped at the position where the same has been stopped by the load on the rocking sinker 8 in holding down the fabric or in preventing the raising motion of the old loop 12 and, consequently, the fabric and the old loop 12 are not damaged.

The power transmitting motions of the sinker jack 3 and the rocking sinker 8 during the course of lowering the needle 1 by the connecting jack 19 connected to the actuator shaft 17 from the clearing position C via a halfway position D to the stitching position B will be described hereinafter.

Figure 7B:
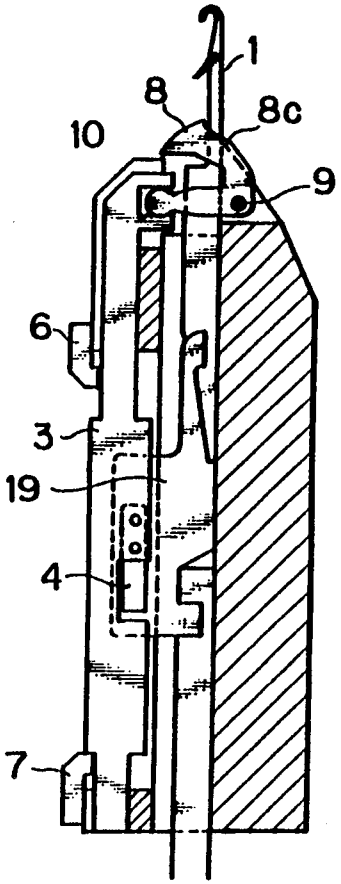
FIGS. 7(A) and 7(B) are a plan view and a longitudinal sectional view similar to FIGS. 5(A) and 5(B), respectively, of a portion of the flat knitting machine in a state in which the needle has been lowered from the clearing position C to a halfway position D.
Figure 7A:
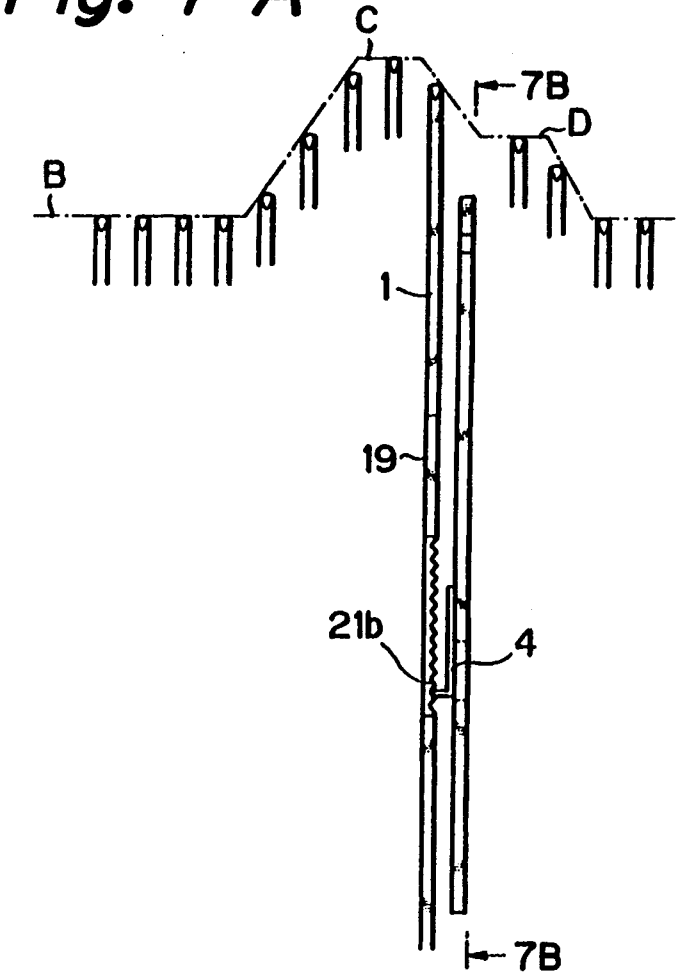

At the beginning of the downward movement of the sinker jack 3, the plate spring 4 is in engagement with the lower portion 21*b* of the serration 21 of the connecting jack 19. The sinker jack 3 is caused to descend together with the connecting jack 19 as the latter descends as long as sinker jack 3 is stopped by the lower stopper 7 because the plate spring 4 is in engagement with the serration 21. As the sinker jack 3 thus descends, the rocking sinker 8 engaging the upper end 10 of the sinker jack 3 is turned counterclockwise on the pin 9 toward the open position where the knitting edge 8*c* of the rocking sinker 8 is set at the working position as shown in FIGS. 7(A) and 7(B).

Figure 8B:
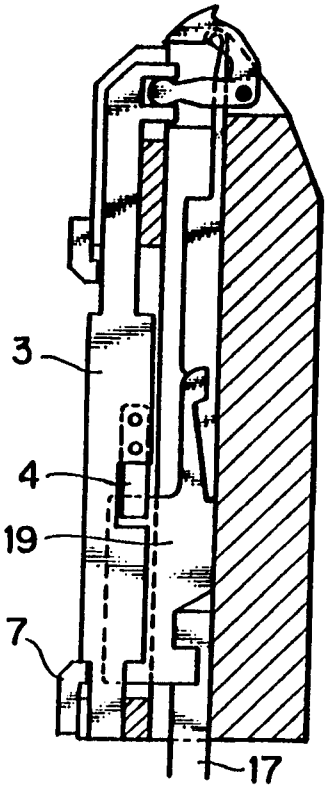
FIGS. 8(A) and 8(B) are a plan view and a longitudinal sectional view similar to FIGS. 5(A) and 5(B), respectively, of a portion of the flat knitting machine in a state in which the needle is at the stitching position.
Figure 8A:
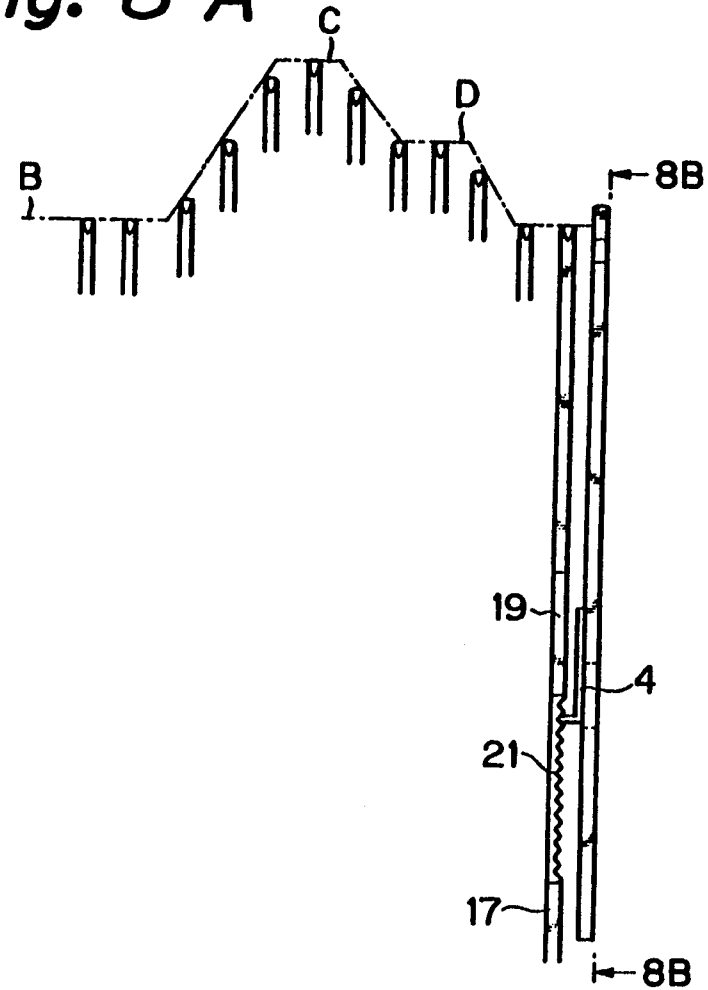

After the sinker jack 3 has been stopped by the stopper 7, the load on the engagement of the plate spring and the serration 21 of the connecting jack 19 increases beyond a certain limit and, consequently, the ridges of the serration 21 ride over the raised end of the plate spring 4 and only the connecting jack 19 continues to descend downward relative to the sinker jack 3. As shown in FIGS. 8(A) and 8(B), the sinker jack 3 is held at its lowermost position by the lower stopper 7 to hold the rocking sinker at the open position, while the needle 1 is lowered via the halfway position D to the stitching position B by the connecting jack 19 connected to the actuator shaft 17.

Figure 12:
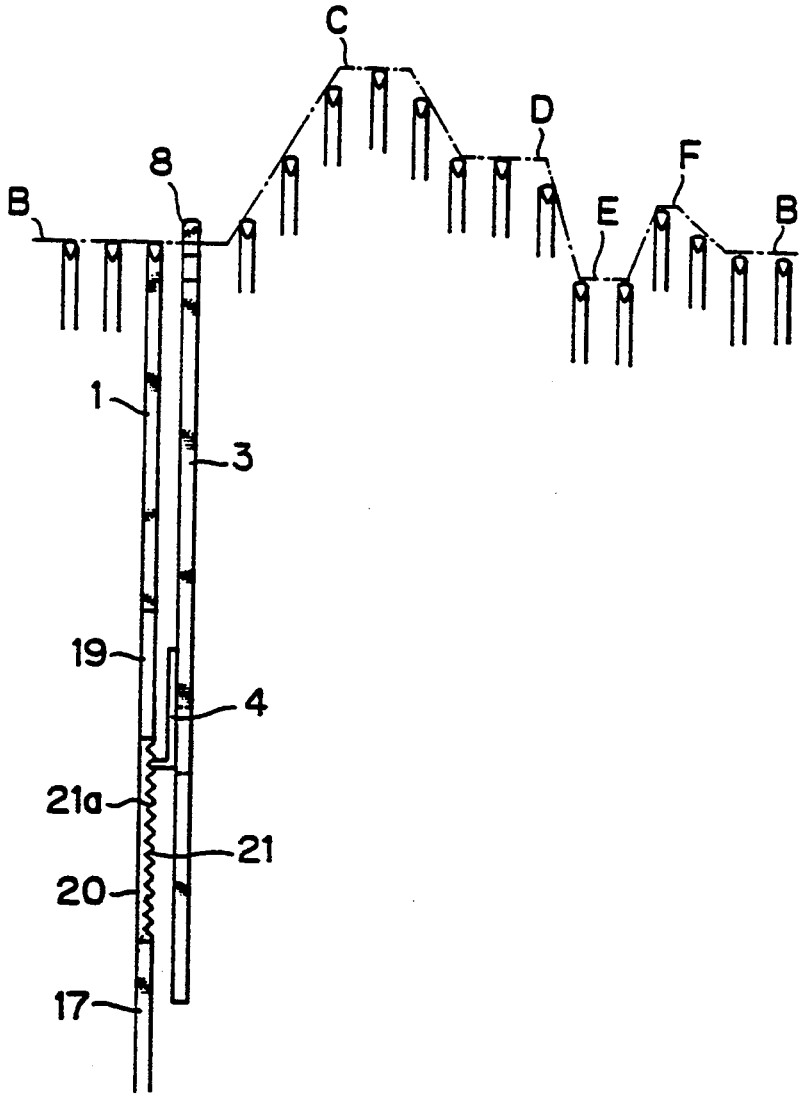
FIG. 12 is a diagrammatic view of a desirable stroke pattern.

Although the operation of the flat knitting machine for controlling the needles in a stroke pattern shown in FIG. 1(A) has been described, it is desirable to control the needles in a stroke pattern shown in FIG. 12 by way of example to deal more flexibly with forming stitches of different stitch sizes.

The stitch size is dependent on the lowermost position E of the needle 1. As the needle 1 is raised from the lowermost position E via a loosening position F to the stitching position B, the rocking sinker 8 is turned from the open position toward the closed position and is turned again to the open position.

Figure 9:
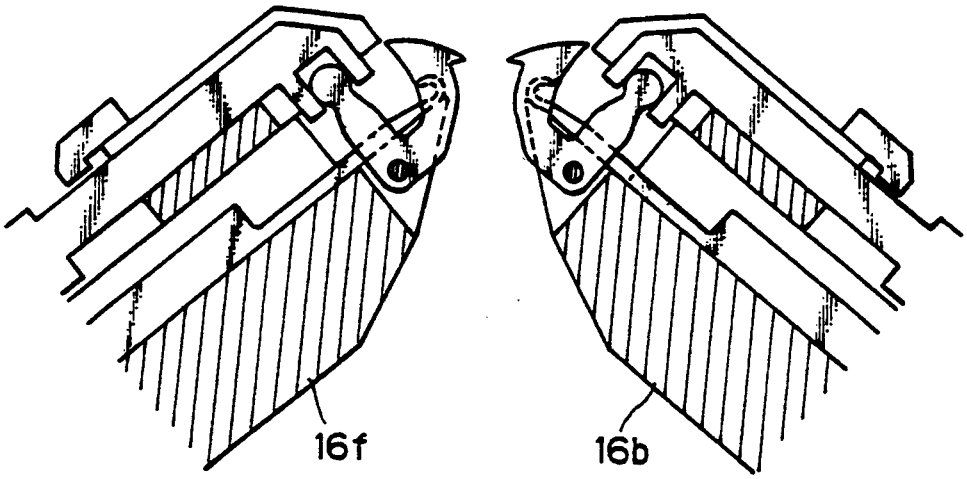
FIG. 9 is a longitudinal sectional view of an essential portion of a flat knitting machine having a front bed and a back bed provided respectively with the rocking sinker and the associated component parts.

The foregoing flat knitting machine is provided with the rocking sinkers 8 and the associated components only on either the front needle bed or the back needle bed. FIG. 9 shows a portion of a flat knitting machine in accordance with the present invention having a front needle bed 16*f* and a back needle bed 16*b* respectively provided with the rocking sinkers and the associated components.

Figure 10A:
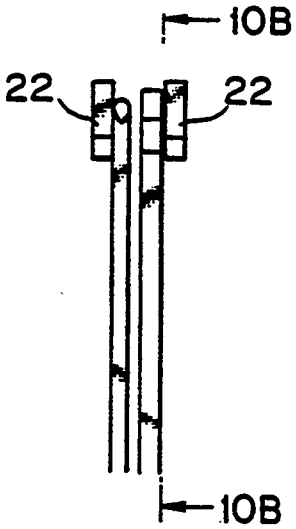
FIGS. 10(A) is a plan view of a portion of a flat knitting machine provided with the rocking sinker supported by another supporting means.
Figure 10B:
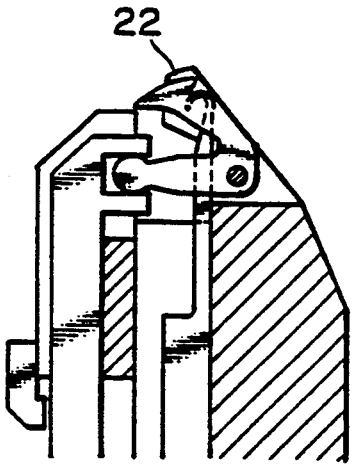
FIG. 10(B) is a longitudinal sectional view taken along the lines A—A of FIG. 10(A)

In the flat knitting machine previously described with reference to FIGS. 1(A) and 1(B), the rocking sinkers 8 are supported pivotally on the upper end of the needle bed 16 with the pins 9, respectively. FIGS. 10(A) and 10(B) show a portion of a flat knitting machine provided with fixed sinkers 22 and rocking sinkers disposed contiguously with the side surfaces of the fixed sinkers 22 and supported pivotally on the fixed sinkers, respectively.

Figure 11:
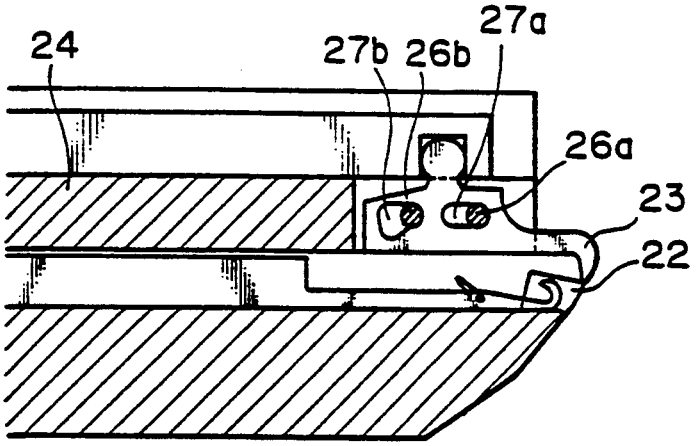
FIG. 11 is a longitudinal sectional view of a portion of a flat knitting machine provided with another rocking sinker supported by another supporting means.

FIG. 11 shows a portion of a flat knitting machine in accordance with the present invention provided with rocking sinkers 23 supported pivotally above fixed sinkers 22, respectively. As shown in FIG. 11, each rocking sinker 23 is supported with two pins 26*a* and 26*b* received respectively in a guide slot 27*a* and a cam slot 27*b* so as to be able to rock along an upper guide member 24. The edges of the guide slot 27*a* and the cam slot 27*b* slide relative to the pins 26*a* and 27*b*, respectively, to enable the rocking sinker 23 to rock for holding down the fabric without interfering with the fixed sinker 22. FIG. 11 shows a state in which the needle is at the stitching position B (FIG. 1(A)) and the rocking sinker 23 is at the open position.

A fabric having a three-dimensional pattern was knitted by a flat knitting machine in accordance with the present invention provided with the rocking sinkers, the components associated with the rocking sinkers, and the needles individually operated by actuator shafts. The fabric was held down satisfactorily by the rocking sinkers and the three-dimensional pattern could be easily formed. Although the conventional cam-driven rocking sinkers are likely to apply an excessively large force to the fabric in holding down the fabric, the rocking sinkers of the present invention did not apply an excessively large force to the fabric in holding down the fabric, did not damage the yarns and enabled the flat knitting machine to knit the fabric with high quality.

The flat knitting machine of the present invention and the method of operating the rocking sinkers of the same flat knitting machine use the motion of the needle operating means for operating the rocking sinkers. Accordingly, the flat knitting machine need not be provided with any cams, which are necessary for operating the known rocking sinkers, and hence the flat knitting machine has a simple construction. Since the rocking sinkers of the flat knitting machine of the present invention do not apply an excessively large force to the fabric in holding down the fabric, the fabric and the yarns are not damaged, and the flat knitting machine is capable of knitting a high-quality knitted fabric.

Although the invention has been described in its preferred form with a certain degree of particularity, obviously many changes and variations are possible therein. It is therefore to understand that the present invention may be practiced otherwise than as specifically described herein without departing from the scope and spirit thereof.

We claim:

1. A flat knitting machine comprising:

two needle beds disposed opposite to each other along a stitching line;

a plurality of needles slidably supported on the two needle beds, respectively;

needle operating means for operating the needles for reciprocal sliding movement on the needle beds;

a plurality of rocking sinkers arranged on at least one of the needle beds in connection with the needles, respectively, so as to rock about an axis parallel to the stitching line;

sinker operating means for operating the sinkers for rocking motion; and frictional engaging means for transmitting movement of the needle operating means to reciprocally move the sinker operating means, wherein the frictional engaging means allows the needle operating means to move free of the sinker operating means when a load on the sinkers exceeds a predetermined frictional engaging force.

2. A knitting machine as claimed in claim 1, further comprising stopper means for engaging the sinker operating means to limit the range of the rocking motion of the sinkers.

3. A knitting machine as claimed in claim 1, wherein the frictional engaging means couples a reciprocally linear moving member of the needles operating means to a reciprocally linear moving member of the sinker operating means.

4. A knitting machine as claimed in claim 1, wherein the frictional coupling means comprise first engaging means carried on the needle operating means and second engaging means carried on the sinker operating means, the first and second engaging means cooperating to generate therebetween a frictional engaging force.

5. A knitting machine as claimed in claim 1, wherein one of said first and second engaging means comprises a serrated member, and the other of said first and second engaging means comprises a resilient plate member engaging serrations in the serrated member.

6. A knitting machine as claimed in claim 5, wherein the plate member is connected to a jack of the needle operating means.

* * * * *